United States Patent [19]

Haes et al.

[11] Patent Number: 4,490,906

[45] Date of Patent: Jan. 1, 1985

[54] SHAVING APPARATUS

[75] Inventors: Freddy Haes; Cornelis M. Reynhout, both of Eindhoven, Netherlands

[73] Assignee: U.S. Philips Corporation, New York, N.Y.

[21] Appl. No.: 416,721

[22] Filed: Sep. 10, 1982

[30] Foreign Application Priority Data

Sep. 11, 1981 [NL] Netherlands ..... 8104201

[51] Int. Cl.[3] ..... B26B 19/14

[52] U.S. Cl. ..... 30/34.2; 30/346.51

[58] Field of Search ..... 30/34.2, 346.51

[56] References Cited

U.S. PATENT DOCUMENTS 3,088,205 5/1963 Ellis ..... 30/34.2

4,281,453 8/1981 Bakker ..... 30/346.51

*Primary Examiner*—Jimmy C. Peters

*Attorney, Agent, or Firm*—Rolf E. Schneider

[57] ABSTRACT

A shaving apparatus is provided with a shear plate having hair-entry apertures and formed with an inner surface, and a cutting unit associated with and drivable relative to the shear plate. The cutting unit comprises cutting elements extending towards the shear plate, each cutting element having an end surface facing the inner surface of the shear plate and being formed with a cutting edge, and hair-pulling elements respectively associated with the cutting elements and positioned in front of the cutting elements in the direction of driving, each hair-cutting element being rigidly connected to its associated cutting element and having a first end surface portion facing the inner surface of the shear plate and being formed with a contact edge. Each contact edge is situated at a greater distance than its associated cutting edge from the inner surface of the shear plate. Each hair-pulling element also has a second end surface portion adjoining the first end surface portion but situated at a greater distance than the first end surface portion from the inner surface of the shear plate to thereby provide a recess between the end surface of each cutting element and the first end surface portion of its associated hair-pulling element.

1 Claim, 6 Drawing Figures

SHAVING APPARATUS

This invention relates to a shaving apparatus comprising a shear plate formed with hair-entry apertures and a cutting unit which is drivable relative to the shear plate and which is provided with cutting elements which extend towards the shear plate and each of which has an end surface which faces the inner surface of the shear plate and is bounded by a cutting edge, the cutting unit also being provided with hair-pulling elements which are rigidly connected to the respective associated cutting elements and each of which has an end surface which faces the inner surface of the shear plate and a contact edge which is situated at a greater distance than the cutting edge of the associated cutting element from the inner surface of the shear plate.

Such a shaving apparatus is known from U.S. Pat. No. 4,281,453. It has been found that the efficient performance of this known shaving apparatus in particular depends on the shape and dimensions of the hair-pulling elements.

The present invention aims at improving the operation of this known shaving apparatus and is characterized in that at least a portion of the end surface of each hair-pulling element is situated at a greater distance than the contact edge of the hair-pulling element from the inner surface of the shear plate.

A special embodiment is characterized in that the portion of the end surface of each hair-pulling element which is situated at a greater distance than the contact edge of the hair-pulling element from the inner surface of the shear plate joins a portion of the end surface of the hair-pulling element which is situated adjacent the contact edge and which extends in a plane substantially parallel to the plane of the inner surface of the shear plate.

A preferred embodiment is characterized in that the front surface of each hair-pulling element which adjoins the the contact edge thereof extends substantially transversely to the inner surface of the shear plate.

The invention will now be described in more detail with reference to the accompanying drawings, in which.

Figure 1:
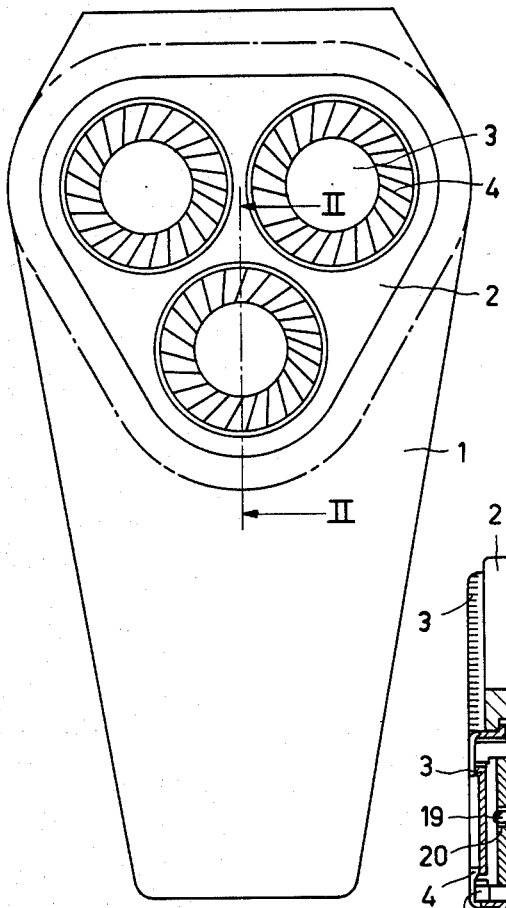
FIG. 1 is a front elevation of a shaving apparatus comprising three shear plates.
Figure 2:
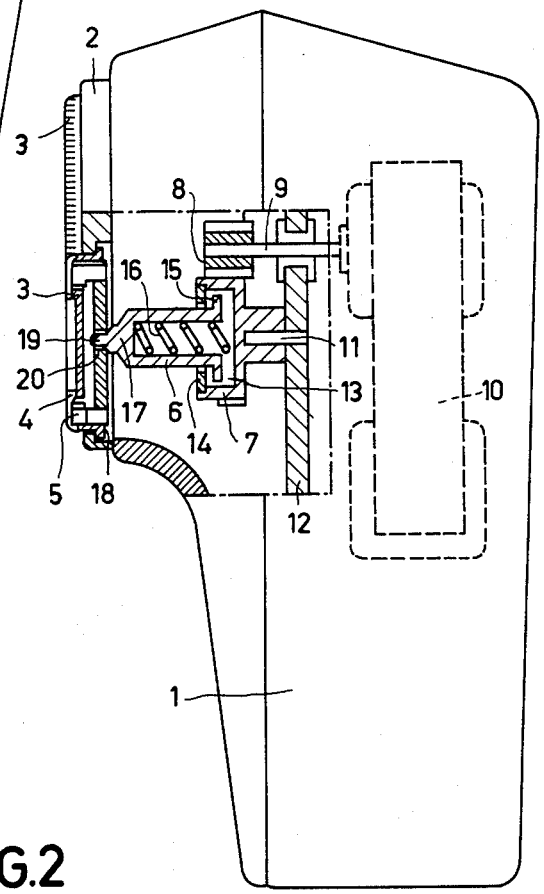
FIG. 2 shows the shaving apparatus of FIG. 1 in side view and partly in a a cross section taken on the line II—II in FIG. 1.

The shaving apparatus shown in FIGS. 1 and 2 comprises a housing 1, of which a part takes the form of a shear plate holder 2 for three shear plates 3. The shear plates 3 are formed with hair-entry apertures 4.

Figure 3:
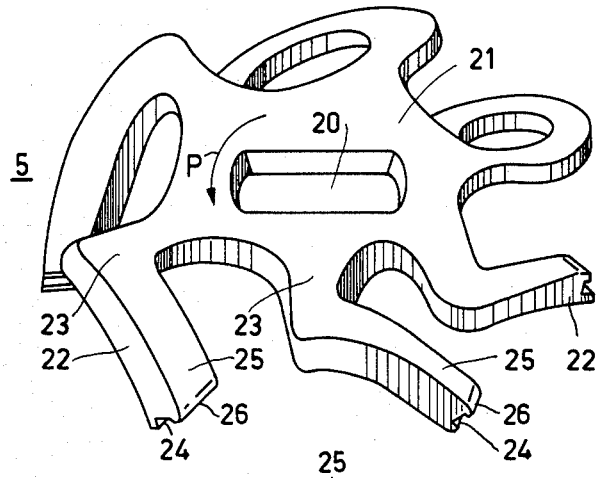
FIG. 3 shows the cutting unit in perspective on an enlarged scale.

FIG. 2 shows a rotary cutting unit 5 arranged at the inner side of a shear plate 3. This cutting unit 5, which for clarity is represented only schematically in FIG. 2, is shown in perspective and on an enlarged scale in FIG. 3. One such cutting unit is provided at the inner side of each shear plate for cooperation therewith.

By means of the hollow spindle 6 (FIG. 2), the gear-wheels 7 and 8 and the spindle 9, the cutting unit 5 is coupled to the electric motor 10 to be rotated thereby relative to the associated shear plate 3. The gear-wheel 7 is rotatably journalled on a pin 11 which is fixed in a mounting plate 12. The gear-wheel 7 is formed with a recess 13 which is closed by a cover plate 14. This recess engages with the flange 15 at the end of the hollow spindle 6. By giving the flange 15 a non-circular, for example square, shape and giving the recess 13 a corresponding shape a coupling is obtained for transmitting the rotary movement of the gear-wheel 7 to the spindle 6, the spindle being tiltable in all directions. The spring 16, which for its greater part is situated in the hollow spindle 6 and which is compressed between the hollow spindle 6 and the gear-wheel 7, exerts a force on the spindle 6, urging it towards the cutting unit 5. A cylindrical portion 17 of the spindle 6 bears against the cutting unit 5 to transmit this force to the cutting unit and via the cutting unit to the shear plate 3, so that a flange 18 on the rim of the shear plate is urged against the shear-plate holder 2. As a result of external forces, which may occur, for example, during use of the shaving apparatus, the shear plate 3 together with the cutting unit 5 and the spindle 6 can be pressed inwards against the action of the spring 16.

A coupling for transmitting the rotary movement of the spindle 6 to the cutting unit is formed by an end portion 19 of the spindle of substantially rectangular cross-section engaging in a correspondingly shaped coupling aperture 20 in the cutting unit 5.

The coupling to the electric motor 10, as described in the foregoing is identical for the three cutting units of the apparatus shown in FIGS. 1 and 2, the three gear-wheels 7 being in mesh with the one centrally disposed gear-wheel 8 on the motor spindle 9.

The cutting unit 5 (FIG. 3) mainly comprises a central body 21 which is formed centrally with the coupling aperture 20 and at its periphery with cutting elements 22 which extend towards the shear plate 3 and which are connected to the central body 1 by the arms 23.

Each cutting element 22 has a cutting edge 24 at its distal end. A hair-pulling element 25 is formed by a rigidly projecting portion of the cutting element, which portion is situated in front of the cutting element, viewed in the direction of driving P of the cutting element. The hair-pulling element is thus rigidly connected to the cutting element, and it has a contact edge 26.

Figure 4:
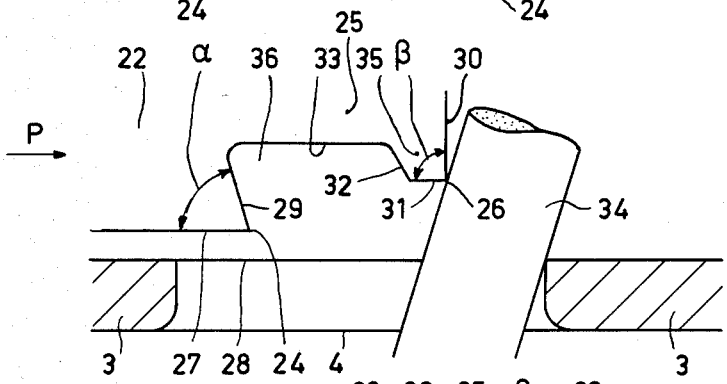
FIGS. 4, 5 and 6 are schematic side views on a further enlarged scale of the respective end surfaces of a cutting element and its associated hair-pulling element with respect to the shear plate.
Figure 5:
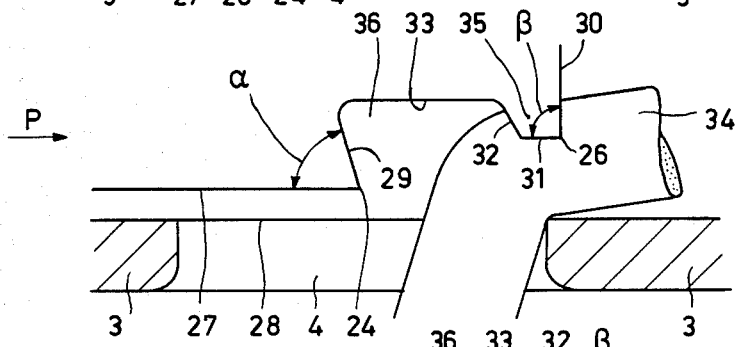
Figure 6:
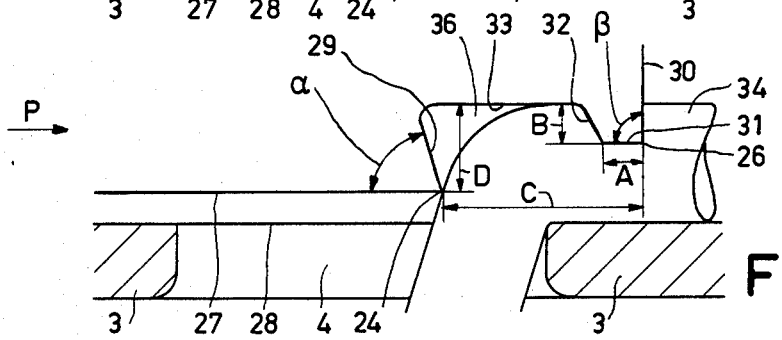

At its distal end each cutting element 22 has an end surface 27 which faces the inner surface 28 of the shear plate 3 (FIGS. 4 to 6). The cutting edge 24 is formed at the junction of the end surface 27 and the front surface 29 of the cutting element 22. The cutting angle $\alpha$ between the end surface 27 and the front surface 29 is 90° or less. The contact edge 26 of each hair-pulling element 25 is situated at the junction of the front surface 30 of the hair-pulling element and a first end surface portion 31 thereof. Measured in a direction perpendicular to the inner surface 28 of the shear plate 3, the contact edge 26 of each hair-pulling element is situated at a greater distance than the cutting edge 24 of the associated cutting element 22 from the inner surface 28 of the shear plate. The first end surface portion 31 extends in a plane substantially parallel to the plane of the end surface 27 of the cutting element and to the plane of the inner surface 28 of the shear plate and is situated at the same distance as the contact edge 26 from the inner surface 28. The angle $\beta$ between the front surface 30 and the first end surface portion 31 is approximately 90° or greater. This is because it has been found that with an acute angle $\beta$ it is more likely that hairs will be severed by the hair-pulling element. The operation of the hair-pulling element, which will be described in more detail hereinafter, then becomes less effective.

Via a connecting surface portion 32 the first end surface portion 31 of each hair-pulling element joins a second end surface portion 33 thereof which also extends in a plane substantially parallel to the plane of the end surface 27 of the cutting element 22 but which is situated at a greater distance than the contact edge 26, from the inner surface 28 of the shear plate measured in a direction perpendicular to the inner surface 28.

In FIGS. 4 to 6 a hair 34 is shown disposed within a hair-entry aperture 4. FIG. 4 represents the instant at which the contact edge 26 of a hair-pulling element has just reached the hair 34. The ridge 35 which is bounded by a pair of the front surface 30 of the hair-pulling element and the first and the connecting end surface portions 31 and 32 thereof penetrates the hair 34 for a substantial distance and moves the hair in the direction of driving P of the cutting unit, the hair thereby being bent over substantially parallel to the shear plate 3 and being slightly pulled up from the skin (FIG. 5). As the movement of the cutting unit continues the cutting edge 24 finally reaches the hair 34 (FIG. 6) and the hair is severed by this cutting edge 24.

Since the second end surface portion 33 of each hair-pulling element is recessed relative to the contact edge 26 thereof, with the result that the recess 36 is formed in the end surface of the hair-pulling element, the part of the hair-pulling element 25 which penetrates the hair, namely the ridge 35, is comparatively small so that reaction forces exerted on the hair-pulling element by the hair 34 are minimized. By means of the construction described in the foregoing, the tendency for the cutting unit to be urged away from the shear plate by said reaction forces, which would have an adverse effect on the efficient operation of the cutting element 22, is minimized.

For a satisfactory performance of the embodiment described in the foregoing the dimensions A, B, C and D indicated in FIG. 6, are very important and stand in close relationship to the average hair diameter. It has been found that an embodiment in which these dimensions are within the following specified ranges performs satisfactorily:

A: 20–30 $\mu$m
B: 30–40 $\mu$m
C: 100–200 $\mu$m
D: 40–100 $\mu$m

The dimension A should be sufficiently large, especially in view of the mechanical strength of the ridge 35 and in view of a satifactory grip on the hairs.

The recess 36 may be bounded by a continuously curved end surface instead of by the flat end surface portions 31, 32 and 33 shown in FIGS. 5 and 6.

It has also been found that a cutting unit provided, as described in the foregoing, with a recess in the base of each hair-pulling element performs particularly well if a constant clearance is maintained between the end surfaces of the cutting elements and the shear plate. This may, for example, be achieved by providing the cutting unit and the shear plate with bearing portions such that these parts are supported in such a way relative to each other that a movement of the cutting unit relative to the shear plate in the direction of driving is possible but a displacement of these parts relative to each other in a direction perpendicular to the direction of driving is impossible.

It will be appreciated that the construction of the cutting elements and their respective associated hair-pulling elements as described in the foregoing may also be used in shaving apparatus of a different type than that described, such as a shaving apparatus having a cutting unit which is reciprocated.

What is claimed is:

1. A shaving apparatus having a shear plate provided with hair-entry apertures and formed with an inner surface, and a cutting unit associated with and drivable relative to the shear plate; said cutting unit comprising cutting elements extending towards the shear plate, each cutting element having an end surface facing the inner surface of the shear plate and being formed with a cutting edge, and hair-pulling elements respectively associated with the cutting elements and positioned in front of said cutting elements in the direction of driving, each hair-pulling element being rigidly connected to its associated cutting element and having a first end surface portion facing the inner surface of the shear plate and being formed with a contact edge, said first end surface portion of each hair-pulling element being situated at a greater distance than the end surface of its associated cutting element from the inner surface of the shear plate, each hair-pulling element also having a second end surface portion adjoining said first end surface portion but situated at a greater distance than said first end surface portion from the inner surface of the shear plate to thereby provide a recess between the end surface of each cutting element and the first end surface portion of its associated hair-pulling element, the first and second end surface portions of each hair-pulling element and the end surface of its associated cutting element extending respectively in planes substantially parallel to the plane of the inner surface of the shear plate, and each hair-pulling element further having a front surface in the direction of driving, said front surface extending substantially perpendicularly to the inner surface of the shear plate.

* * * * *